US011578542B2

(12) United States Patent
Abdollahi et al.

(10) Patent No.: US 11,578,542 B2
(45) Date of Patent: Feb. 14, 2023

(54) AT-THE-BIT MUD LOSS TREATMENT

(71) Applicant: Prores AS, Trondheim (NO)

(72) Inventors: Jafar Abdollahi, Trondheim (NO); Inge Manfred Carlsen, Ranheim (NO)

(73) Assignee: PRORES AS, Trondheim (NO)

( * ) Notice: Subject to any disclaimer, the term of this patent is extended or adjusted under 35 U.S.C. 154(b) by 32 days.

(21) Appl. No.: 17/059,899

(22) PCT Filed: Jun. 3, 2019

(86) PCT No.: PCT/NO2019/000013
§ 371 (c)(1),
(2) Date: Nov. 30, 2020

(87) PCT Pub. No.: WO2019/231332
PCT Pub. Date: Dec. 5, 2019

(65) Prior Publication Data

US 2021/0123307 A1 Apr. 29, 2021

(30) Foreign Application Priority Data

Jun. 1, 2018 (NO) ..... 20180753

(51) Int. Cl.
*E21B 21/00* (2006.01)
*E21B 21/10* (2006.01)
(Continued)

(52) U.S. Cl.
CPC ..... *E21B 21/003* (2013.01); *E21B 21/103* (2013.01); *E21B 33/138* (2013.01); *E21B 44/005* (2013.01); *E21B 47/10* (2013.01)

(58) Field of Classification Search
CPC ..... E21B 21/003; E21B 21/103; E21B 27/02; E21B 33/13; E21B 33/138; E21B 47/10
See application file for complete search history.

(56) References Cited

U.S. PATENT DOCUMENTS 2,815,190 A 12/1957 Dawson, Jr.
3,318,378 A 5/1967 Coshow
(Continued)

FOREIGN PATENT DOCUMENTS

EP 0722037 A2 * 7/1996 ..... E21B 33/16
GB 2 204 894 A 11/1988
(Continued)

OTHER PUBLICATIONS

Norwegian Search Report dated Nov. 26, 2018 for Application No. 20180753 with an English translation.
(Continued)

*Primary Examiner* — Jennifer H Gay
(74) *Attorney, Agent, or Firm* — Birch, Stewart, Kolasch & Birch, LLP

(57) ABSTRACT

A while drilling mud loss treatment method includes providing a drilling tool main body with a through bore connected to an above arranged wired drill pipe string with a communication line to a topsides monitoring and control system, the drilling tool main body connected to a below arranged one or more drill collar sections with a lower of said drill collar sections connected to a drill bit, and drilling in a well. The main body is provided with an annular tank with a swellable sealant and the annular tank has a valve to an outlet to the through bore. A control system in the main body receives MWD sensor signals from an MWD sensor system and controls the valve having a valve actuator. The control system is, during drilling, running a monitoring and control algorithm using the signals as input for detecting an undesired mud loss state during drilling, and, if a mud loss state is detected, to command said valve actuator to open said valve upon detecting an undesired mud loss state, so as for ejecting said swellable sealant to said through bore.

20 Claims, 3 Drawing Sheets

Figure 1:
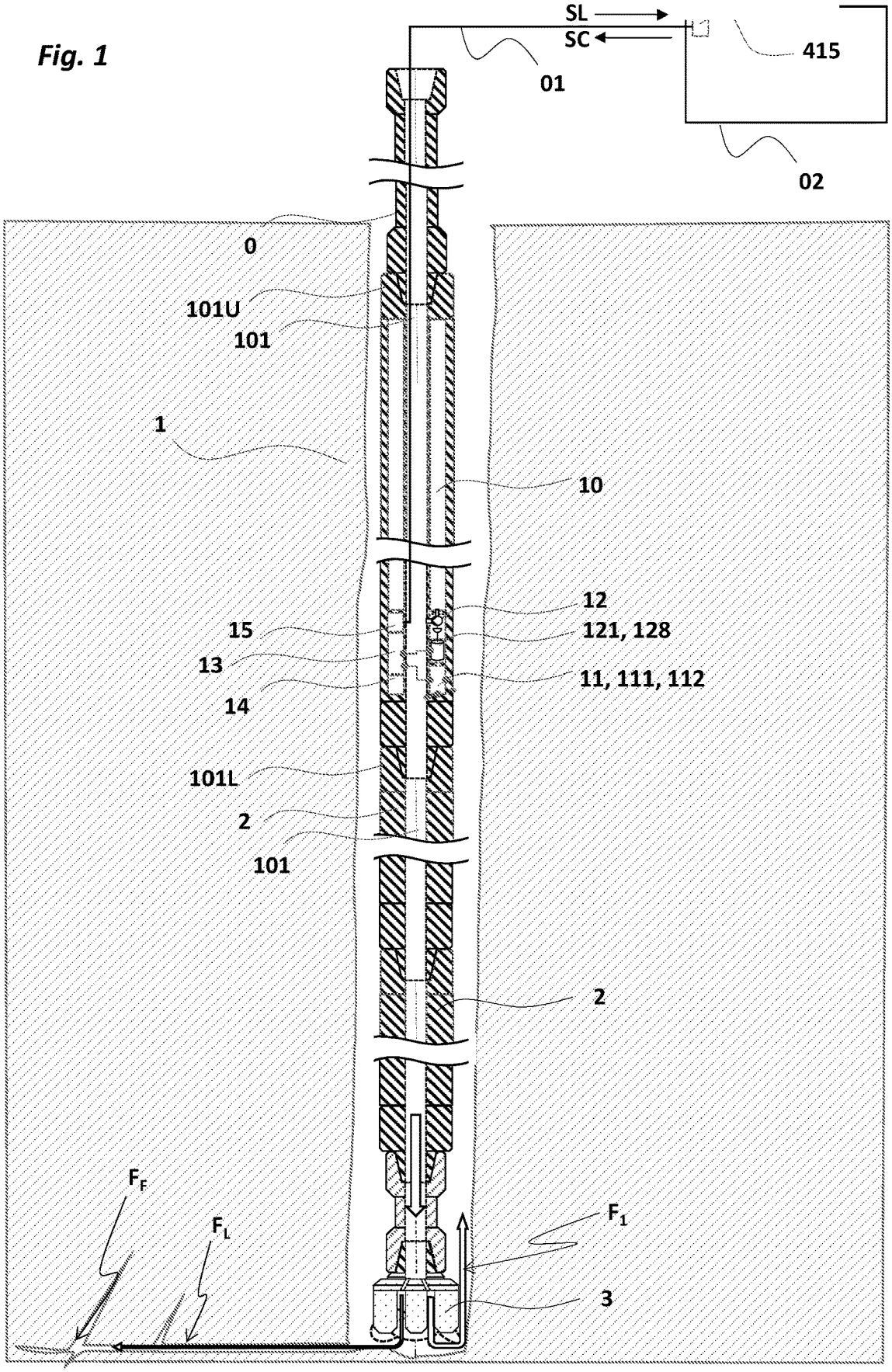

(51) Int. Cl.

| | |
|---|---|
| ***E21B 33/138*** | (2006.01) |
| ***E21B 44/00*** | (2006.01) |
| ***E21B 47/10*** | (2012.01) |

(56) References Cited

U.S. PATENT DOCUMENTS

| | | | | |
|---|---|---|---|---|
| 3,637,019 | A | 1/1972 | Lee | |
| 5,343,968 | A * | 9/1994 | Glowka | E21B 34/12 175/215 |
| 5,533,570 | A * | 7/1996 | Streich | E21B 27/02 166/333.1 |
| 7,624,803 | B2 * | 12/2009 | Daccord | E21B 33/138 166/305.1 |
| 7,891,424 | B2 | 2/2011 | Creel et al. | |
| 8,047,298 | B2 * | 11/2011 | Solhaug | E21B 33/1208 166/387 |
| 8,136,594 | B2 * | 3/2012 | Streich | E21B 27/02 405/269 |
| 8,453,750 | B2 * | 6/2013 | Solhaug | E21B 33/1208 166/387 |
| 10,851,616 | B2 * | 12/2020 | Knight | E21B 34/063 |
| 11,261,692 | B2 * | 3/2022 | Li | E21B 47/017 |
| 2007/0246225 | A1 | 10/2007 | Hailey et al. | |
| 2008/0093077 | A1 * | 4/2008 | Daccord | E21B 27/02 166/310 |
| 2009/0294133 | A1 * | 12/2009 | Shindgikar | E21B 23/006 166/374 |
| 2011/0220350 | A1 * | 9/2011 | Daccord | E21B 49/005 166/305.1 |
| 2013/0160998 | A1 * | 6/2013 | Auzerais | E21B 47/04 507/104 |
| 2013/0269928 | A1 | 10/2013 | Zhou | |
| 2016/0024863 | A1 | 1/2016 | Badri et al. | |
| 2016/0201410 | A1 | 7/2016 | Zhou | |
| 2018/0187492 | A1 * | 7/2018 | Amri | E21B 7/28 |
| 2019/0169955 | A1 * | 6/2019 | Knight | E21B 37/045 |
| 2020/0248512 | A1 * | 8/2020 | Hitchcock | E21B 33/138 |
| 2021/0189811 | A1 * | 6/2021 | Harbi | E21B 33/1208 |

FOREIGN PATENT DOCUMENTS

| | | | | |
|---|---|---|---|---|
| GB | 2523747 | A * | 9/2015 | E21B 17/18 |
| NO | 345437 | B1 | 2/2021 | |
| WO | WO 2008/022141 | A1 | 2/2008 | |
| WO | WO 2008/077499 | A1 | 7/2008 | |
| WO | WO 2009/134578 | A2 | 11/2009 | |
| WO | WO 2011/119668 | A1 | 9/2011 | |
| WO | WO 2017/173540 | A1 | 10/2017 | |

OTHER PUBLICATIONS

International Preliminary Report on Patentability, issued in PCT/N02019/000013, dated Sep. 29, 2020.

International Search Report, issued in PCT/N02019/000013, dated Dec. 13, 2019.

Written Opinion of the International Searching Authority, issued in PCT/N02019/000013, dated Dec. 13, 2019.

* cited by examiner

AT-THE-BIT MUD LOSS TREATMENT

INTROCUCTION

The present invention relates to a mud loss treatment drilling tool for use on a drill string and arranged for communicating on a communication line (01) to a topsides monitoring and control system (02). The tool is in use arranged together with one or more drill collar sections (2) with a lower of said drill collar sections (2) connected to a drill bit (3) with nozzles. The tool's main body (1) is provided with an annular tank (10) with a swellable sealant (5) and the annular tank (10) has an outlet (120) to the tool's through bore (101), which is connected to the drill collars through bore. A valve (12) of the tank (10) has a valve actuator (121, 128) controlled by a control system (13) receiving MWD sensor signals from an MWD sensor system (11) of the tool and continuously analyzing whether there is an undesired mud loss state (to fractures or to the formation) or whether the drilling proceeds with little or acceptable mud loss. The tool further has a control system (13) with an algorithm (131) arranged for processing at least those downhole MWD sensor signals, but optionally also surface measured drilling parameters such as flow rates in and out of the well, in order to command the valve actuator (121, 128) to allow the tank (10) ejecting its swellable sealant (5) to the through bore (101) upon said algorithm (131) having detected such an undesired mud loss state described above. The swellable sealant (5) is arranged for, when ejected from said outlet (120) to contact said drilling mud in said main bore (101), to start reacting to swell during the time it takes said drilling mud with said swellable sealant (5) to pass out through the drilling bit nozzles, and continue to swell and set while said drilling mud being placed in a fracture extending from the borehole being drilled by said drill bit (3). In this manner, the drilling may be continued without interruption from retrieving the drill string from the well and cementing or patching the actual zone, and the loss of drilling time is significantly reduced. Excessive swellable sealant remaining in the annulus about the bottomhole assembly after the mud loss state has been remedied may be diluted in the drill string annulus and circulated out of the well in the normal circulation way.

BACKGROUND ART

Examples of background art on fluid loss control are given in the overview below:

US20160024863 Badri et al., Schlumberger, describes pumping down swellable particles to a lost circulation zone.

WO200807499 Shindghikar, Schlumberger, describes pumping down a polymer to cure a lost circulation zone. The materials are pumped in via the drill string and its annulus from surface.

U.S. Pat. No. 3,637,019 Lee, describes pumping down two components A and B and water through concentric pipes to form polyurethane to cure a lost circulation zone. The materials are pumped in via the drill string and two conduit pipes from the surface down to the drill bit. It mixes A and B components to form polyurethane.

US20130160998 Auzerais et al. describes circulation of a more or less conductive dopant to the drilling mud, and an electromagnetic apparatus for measuring mud electric properties, in order to detect the location of fluid loss in a wellbore.

US20130269928 Zhou, Saudi Aramco, describes a recirculation valve for use in a drill string for creating a bypass flow to the return annulus for the drilling mud.

US20110110350 US20110220350 Daccord et al., Schlumberger, describes in its claim 8:

8. A method for subterranean well treatment, comprising:
(i) placing a tubular body in a wellbore, the tubular body being equipped with:
(a) a drill bit, the drill bit having at least one nozzle;
(b) at least one sensor attached to the outer surface of the tubular body, the sensor being capable of measuring a parameter that directly correlates to fluid-flow rate in the annulus between the outer surface of the tubular body and the wellbore wall; and
(c) means to transmit the parameter to the surface;
(ii) recording the parameter and transmitting the parameter to the surface;
(iii) identifying the depth, the severity, or both, of the zone to be treated; and
(iv) pumping a treatment fluid at the identified depth It pumps the treatment fluid from surface, an operation which takes much time if encountering a loss of circulation of drilling fluid. Moreover, transmitting a signal to surface when undesired mud loss occurs may not be feasible if there is a lack of drilling fluid in the mud signal path from the tool to the surface, which is a risk when encountering a mud loss state incurring a loss of circulation.

US20160201410 Zhou, Saudi Aramco, describes a loss mitigation bottom hole assembly for isolating a loss zone of a formation, including a drill bit and a dual wall drill string connecting the drill bit to a fluid source, and having a fluid passage for delivering fluid to a drill bit, and another fluid passage for returning the fluid away from the drill bit. The assembly further includes a drilling liner circumscribing and attached to a lower portion of the dual wall drill string, and surrounding the drill bit, the drilling liner having an end adjacent to the drill bit to contain the fluid exiting the drill bit and prevent the fluid from entering the severe loss zone of the formation. It thus has a purely mechanical solution to avoid loss of mud, no chemical fluid to enter and seal fractures.

WO2008022141 Bussear, Baker Hughes, describes a fluid loss control system and method for controlling fluid loss. It describes a fluid loss control system having a loss control valve and a plurality of zones comprising: an isolation assembly disposed in a wellbore, and a string with a stinger and supporting a moveable seal at a position uphole of the stinger, firstly, to cause engagement of the seal with the assembly before the stinger is engageable with the valve and to position the moveable seal relative to the isolation assembly to facilitate fluid flow around the seal when the stinger is engaged with a seal bore of one of the many zones.

U.S. Pat. No. 5,343,968 Glowka, USDoE, Describes a downhole material injector for lost circulation control. It is an apparatus and a method for simultaneously and separately emplacing two streams of different materials through a drillstring in a borehole to a downhole location for lost circulation control. The two streams are mixed outside the drillstring at the downhole location and harden after mixing, for controlling the lost circulation zone. The remedying fluids are pumped all the way from surface.

U.S. Pat. No. 3,318,378 Coshow, describes a method of sealing vuggy regins in wellbores, comprising detecting a vuggy portion of the well being drilled, and halting water circulation and withdrawing the drillstring from the well, placing an open ended drill pipe into the bore and pumping in lost-circulation material into the vuggy formation, and detonating an explosive charge to seal the vuggy formation. The removal of the drill string from the well is a time-consuming disadvantage.

U.S. Pat. No. 2,815,190 Dawson, describes a process and apparatus for preventing loss of circulation of drilling fluid. It comprises an auger screw fed by a drill pipe string and arranged for compressing loss of circulation material in order to eject it in a desired portion of a well. The loss of circulation material is fed from the surface through the drill string.

GB2204894 describes a method and device for sealing lost circulation zones in bore holes. A lost circulation zone in a bore hole is sealed by a cement slurry which is pumped down a drill pipe string and which is centrifugally separated into phases of higher and lower densities once it has left the drill pipe string, the separated lower density phase being directed to the surface via an annular space, the higher density phase remaining near the lost circulation zone.

U.S. Pat. No. 7,891,424 Creel et al., Halliburton, "Method of delivering material downhole, describes the use of a closed container lowered on wireline into a wellbore in contact with a subterranean formation, down to a loss zone, wherein container contains a swelling agent which comprises a superabsorber, and wherein the superabsorber comprises a dehydrated, crystalline polymer. The container is lowered into the well on a wireline.

US 2007/0246225 A1 discloses a well tool and a method of actuating the well tool. The well tool utilizes swellable material and comprises an actuator which actuates the well tool in response to contact between a swellable material and a well fluid.

WO 2011/119668 A1 discloses an apparatus and a method for well modifying a return fluid in a wellbore comprising disposing at least one valve along a drill pipe section of a drill string in the wellbore. At least one parameter of interest is determined at at least one location along the wellbore. At least one valve is controllably actuated to discharge at least a portion of at least one fluid from inside the drill string to an annulus in the wellbore to modify a local property of the return fluid in the annulus based at least in part on the measured parameter of interest.

BRIEF SUMMARY OF THE INVENTION

The invention is a mud loss treatment drilling tool comprising:

a main body (1) with a through bore (101), and an upper tooljoint (101U) to connect to an above arranged drill pipe string (0) with an associated communication line (01) to and from a topsides monitoring and control system (02), and a lower tooljoint (101L) to connect to a below arranged one or more drill collar sections (2) with a lower of said drill collar sections (2) connected to a drill bit (3) with nozzles, said main body (1) provided with an annular tank (10) with a swellable sealant (5), said annular tank (10) having an outlet (120) to said through bore (101), and a valve system (12) having a valve actuator (121, 128) controlled by a control system (13) receiving MWD sensor signals from a MWD sensor system (11) with an algorithm (131) arranged for monitoring, wherein said control system (13) and said MWD sensor system (11) are powered by an energy source (14), wherein said control system (13) and said MWD sensor system (11) are arranged within said main body (1), said control system (13) having an algorithm (131) arranged for monitoring and processing at least said MWD sensor signals in order to detect an undesired mud loss state, said control system (13) further arranged for commanding said valve actuator (121, 128) to allow said annular tank (10) ejecting said swellable sealant (5) to said through bore (101) upon said algorithm (131) having detected such an undesired mud loss state, said swellable sealant (5) is arranged for, when ejected from said outlet (120), to contact said drilling mud in said through bore (101), to start reacting to swell during the time it takes said drilling mud with said swellable sealant (5) to pass out through the drilling bit nozzles, and continue to swell and set while said drilling mud being placed in a fracture extending from a borehole being drilled by said drill bit (3).

BRIEF FIGURE CAPTIONS

FIG. 1 is a rough sketch of an embodiment of the invention with a bottom hole assembly comprising, from bottom to top, a drill bit drilling and encountering an induced or natural fracture ($F_F$) wherein mud loss occurs; a series of drill collars, and a mud loss treatment tool (1) according to the invention. A main bore (101) is arranged through the tool (1). The mud loss treatment tool (1) has a concentric tank (10) arranged about the main bore (101), the tank (10) contains a swellable sealant (5) arranged for being injected to said main bore (101) and to be ejected through the drill bit nozzles together with drilling mud in order to start swelling and "get lost" into said fracture and partly or fully block throats in said fracture.

Figure 2:
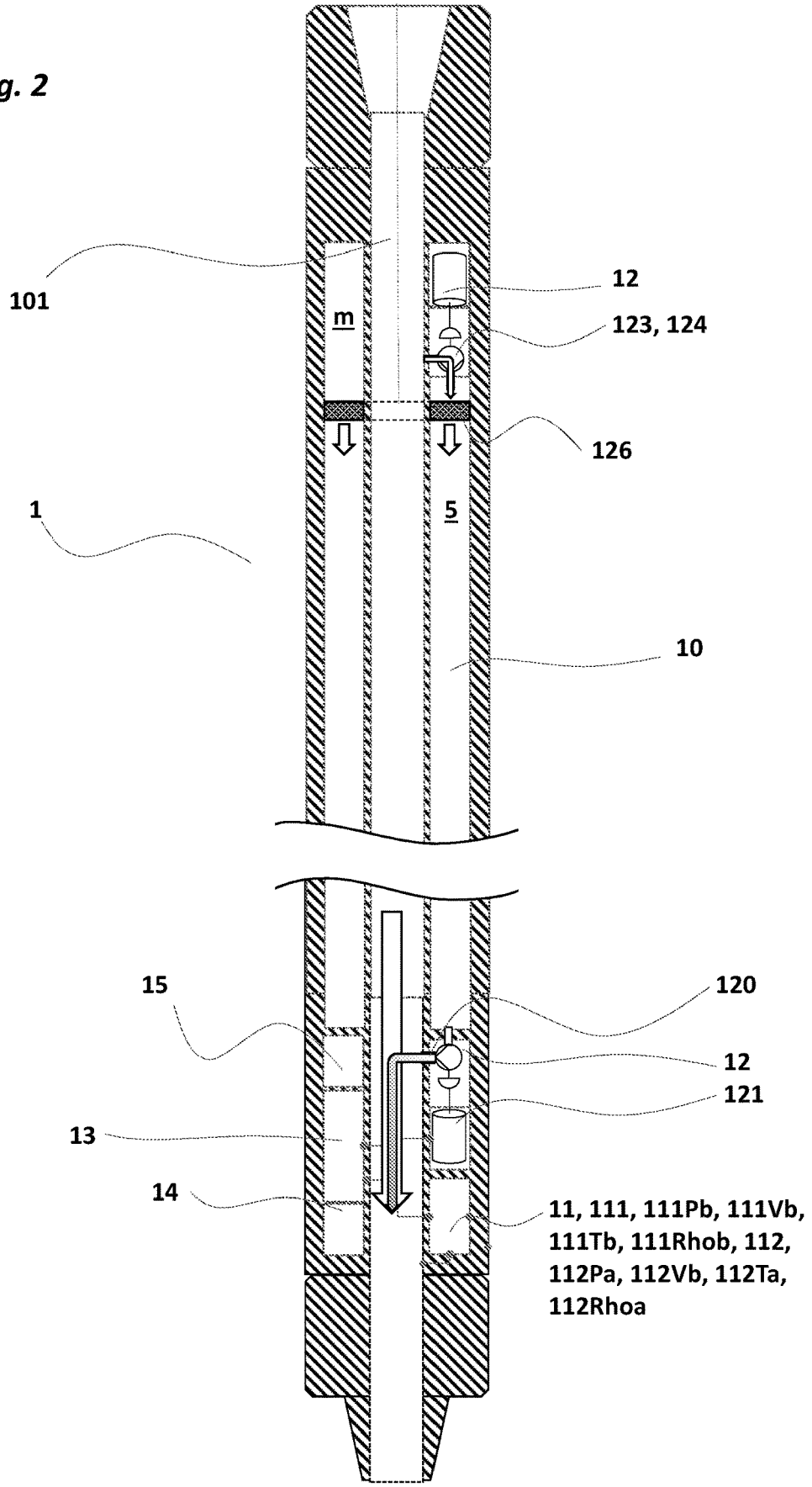

FIG. 2 is an enlarged detail of an embodiment of the mud loss treatment tool (1). In FIG. 2, the mud loss treatment tool (1) is shown as been designed similar to a drill collar, i.e. with a similar diameter and pin and box connections similar to those of a drill collar. A different diameter may be used. The swellable sealant (5) is released upon the tool's control system (13) having detected an undesired mud loss state, and the swellable sealant (5) is carried along with the drilling mud in the main bore down through the drill collars and out through the nozzles of the drill bit, whereby it will follow the flow out to the fractures where the undesired loss occurs. There it will swell to form a gel and in the throats of the fractures may temporarily or permanently halt and cure the mud loss so as for drilling to continue undisturbed. The embodiment of the invention shown in FIG. 2 has an inlet valve/pump (124) for allowing drilling mud in from the main bore (101) and an outlet valve (12)/pump for releasing the swellable sealant to the main bore (101).

Figure 3A:
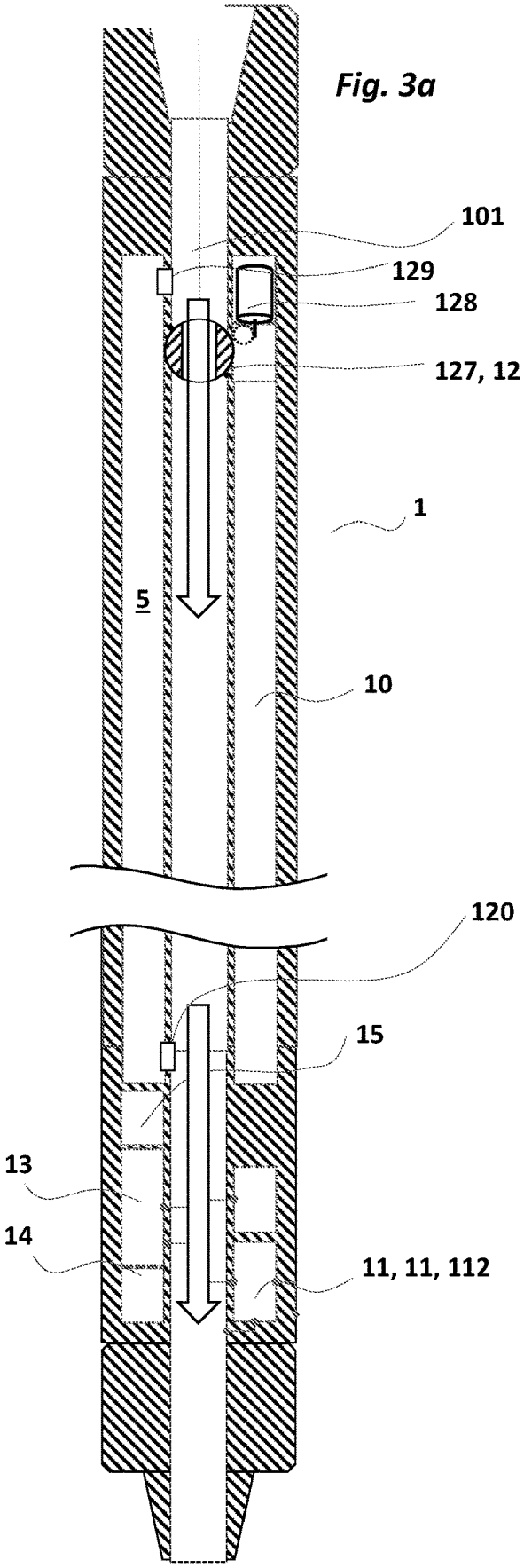
Figure 3B:
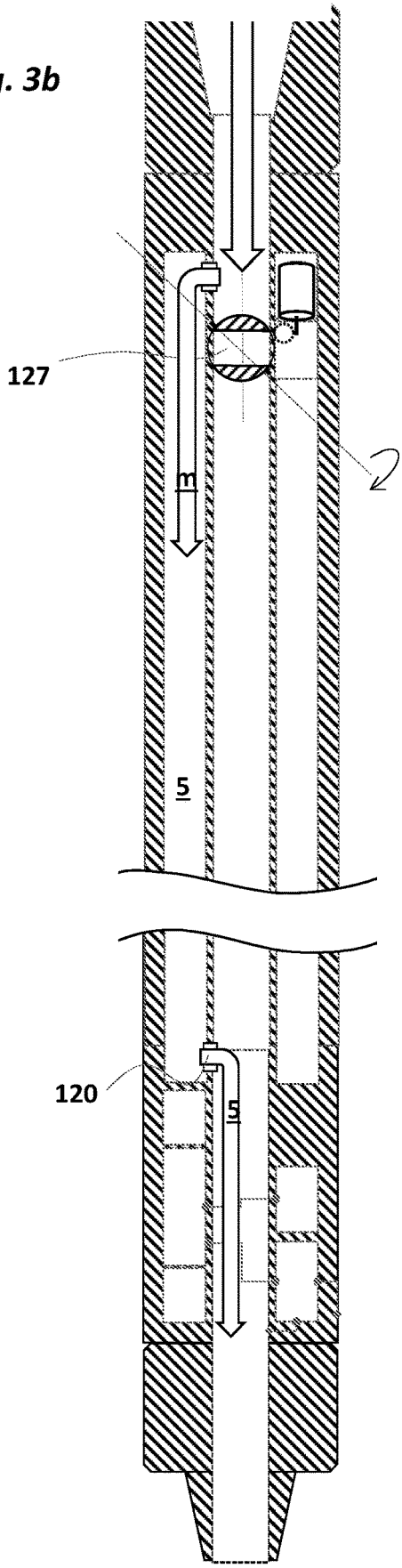

FIGS. 3*a* and 3*b* are enlarged details of another embodiment of the mud loss treatment tool (1). In these Figures, the mud loss treatment tool (1) are shown as been designed similar to a drill collar. The embodiment shown here has a diverter valve (127) in the main bore in order to divert drilling mud flow from the main bore (101) into an upper inlet (129) to displace swellable sealant (5) in the tank (10) to be released through a lower outlet (120) back into the main bore (101). In a further embodiment the inlet (129) and the outlet (120) may be provided with a shear membrane rupturing upon a differential pressure across them. FIG. 3*a* shows the mud loss treatment tool (1) when the diverter is not activated, and FIG. 3*b* shows the mud loss treatment tool (1) when the diverter is activated.

DESCRIPTION OF EMBODIMENTS OF THE INVENTION

The invention is a mud loss treatment drilling tool arranged for ejecting a swellable sealant (5) while drilling, if detecting an undesired mud loss state. Thus the invention is also a method of ejecting a swellable sealant (5) to undesired fractures occurring while drilling, for halting undesired mud loss. The inventors have loosely compared the mud loss drilling tool to an airbag, but this tool goes beyond comparison, it may halt and cure the undesired mud loss state, but it also allows continued drilling "as if nothing had happened". A major advantage of the invention is, that after having controlled an undesired mud loss, i.e. after and during controlling the undesired mud loss using the present invention, without interrupting the drilling or retrieving the drilling string, the drilling may continue essentially uninterrupted by the occurrence of the undesired mud loss. This is a significant advantage over the background art.

The device:

The invention is a mud loss treatment drilling tool comprising a main body (1) with a through bore (101), an upper tooljoint (101U) to an above arranged drill pipe string (0) with a communication line (01) to a topsides monitoring and control system (02), a lower tooljoint (101L) to a below arranged one or more drill collar sections (2) with a lower of said drill collar sections (2) connected to a drill bit (3). The main body (1) is provided with an annular tank (10) with a swellable sealant (5). The annular tank (10) has a valve system (12) allowing the swellable sealant (5) to be released from the tank (10) through an outlet (120) to said through bore (101). The valve system (12) has a valve actuator (121, 128) controlled by a control system (13) receiving MWD sensor signals from an MWD sensor system (11). The control system (13) and said MWD sensor system (11) are powered by an energy source (14), wherein said control system (13) and said MWD sensor system (11) are arranged within said main body (1). The control system (13) has an algorithm (131) arranged for processing at least the MWD sensor signals in order to command the valve actuator (121, 128) to activate the valve system (12) upon having detected an undesired mud loss state, so as for allowing the tank (10) ejecting said swellable sealant (5) to said through bore (101).

In an embodiment of the invention, the energy source (14) is arranged within the tool body (1). In an embodiment of the invention, the energy source (14), the downhole modem and communication terminal (15) is arranged in the annulus part of the mud loss treatment tool body (1). The components are arranged outside the main central bore (101). In an embodiment of the invention the energy source (14) is a battery. The energy source (14) is arranged adjacent to the control system (13) and the control system is connected to the valve actuators (121, 128) and to the MWD sensor system (11). In an embodiment the MWD sensor system (11) is connected to one or more internal bore sensors (111) and one or more annulus arranged sensors (112), see FIG. 1.

In an embodiment of the invention, mud (m) is allowed into the tank (10) behind a piston (126), which again forces out the swellable sealant, see FIG. 2.

The method:

Analoguely, the corresponding while drilling mud loss treatment method comprises providing a drilling tool main body (1) with a through bore (101) connected to an above arranged drill pipe string (0) with an associated communication line (01) to a topsides monitoring and control system (02), the drilling tool main body (1) connected to a below arranged one or more drill collar sections (2) with a lower of said drill collar sections (2) connected to a drill bit (3), and drilling in a well. The main body (1) is provided with an annular tank (10) with a swellable sealant (5) and the annular tank (10) has a valve system (12) for activating release of the swellable sealant (5) to an outlet (120) to the through bore (101). A control system in the main body (1) receives MWD sensor signals from an MWD sensor system (11) in the main body (1). The control system (13) and MWD sensor system (11) both receives energy from an energy source (14) in said main body. The control system (13) controls the valve system (12) having a valve actuator (121, 128) to release the swellable sealant (5) to the main bore (101). The control system (13) is, during drilling, running a monitoring and control algorithm (131) using the signals as input for detecting an undesired mud loss state during drilling, and, if a mud loss state is detected, to command said valve actuator (121) to activate said valve system (12) upon detecting an undesired mud loss state, so as for ejecting said swellable sealant (5) from the tank (10) to said through bore (101).

The valve system (12) may be controlled by the control system (13) to close after a given dose of the swellable sealant (5) from the tank so as for being prepared to repeat the remedying operation if further mud loss states are detected either at the same depth as the first release of swellable sealant occurs or further down, or it may be designed to go "all in" and eject the entire contents of the tank (10) in one round. This could be pre-programmed in the control system depending on the risk assessment of the well under drilling based on its own and neighbouring wells history. If being emptied the tool should be routinely replenished with new swellable sealant (5) when being retrieved to the surface.

In an embodiment of the invention, the swellable sealant (5) is arranged for, when ejected from said outlet (120) to said drilling mud, to start reacting with said drilling mud to swell during the time it takes said drilling mud with a portion of said swellable sealant (5) to pass through the drilling bit nozzles, and continue to swell and set while said drilling mud being placed in a fracture extending from a borehole being drilled by said drill bit (3). Further, the annular tank (10) may be provided with a piston (126) for driving out said swellable sealant (5) to the outlet valve of said valve system (12).

As an example, the tank (10) may hold 50-200 litres, preferably 100 litres, of swellable agent (5). The swellable agent (5) will start swelling when in contact with water in the drilling mud or in the fracture fluid. The swellable agent (5) may expand about 100 times when in contact with water, and will efficiently block throats in fractures.

In an embodiment of the invention, the annular tank (10) is provided with an inlet valve or pump (124) with a mud balancing pressure inlet (129) from said central bore (101) near an upper end of said annular tank (10) and provided with an inlet valve actuator (123), the pump or valve contributing to driving said piston (126). A small controlled explosively or otherwise expanding charge may also be used to create pressure to make the piston (126) drive out the swellable sealant (5). In this embodiment the piston as such may be optional. Please note that the use of a piston which is displaced by inflowing drilling mud will isolate the incoming drilling mud from the displaced swellable sealant (5) thus preventing reaction of the mud and swellable sealant within the confines of the tank (10) itself, which will safeguard the portioning opion mentioned elsewhere in this description.

The MWD sensor system (11) is provided with one or more of internal bore sensors (111) and/or annulus sensors (112), such as:

- bore mud pressure (111Pb) sensor
- bore mud flow velocity (111Vb) sensor (ultrasonic Doppler)

annulus mud pressure (112Pa) sensor, mud pressure bore/annulus differential pressure (Pb-Pa) sensor
annulus mud velocity (112Va) sensor (ultrasonic Doppler)
bore temperature (111Tb) sensor
annulus temperature (112Ta) sensor, temperature bore/annulus differential temperature (Ta-Tb) sensor
bore mud density (111Rho b) sensor
annulus mud density (112Rho a) sensor.

With the above sensors it is possible to detect a sudden loss of mud to a fracture. A fracture may occur naturally or be induced due to overbalanced pressure. Anyway, the drill bit suddenly comes in communication with a fracture, and the desired circulation of drilling mud (F1) down the drill pipe string, the drill collars and out through nozzles in the drill bit, further with the drilling mud carrying away heat and cuttings up along the drill collar annulus, is reduced, and part of the drilling mud is lost to the fracture. The annulus mud pressure (112Pa) may drop or may drop relative to the bore mud pressure (111Pb). The annulus velocity (112Va) (which may be measured using an ultrasonic Doppler) of the return drilling mud may drop due to the reduced flow of drilling mud. The reduced return of drilling mud may incur an increased annulus temperature (112Ta) while drilling. All or some of these parameters may be used in an algorithm for detecting an undesired mud loss state during drilling.

In an embodiment of the invention the control system (13) is arranged for communicating a signal representing said undesired mud loss state via a communication terminal or downhole modem (15) to a surface modem (415) to a surface control system, so as for receiving a surface triggering command signal to said valve actuator (121) to open said valve (12) for ejecting said swellable sealant (5). This may give the driller a choice to assess the situation, possibly considering surface measurements such as circulation rate and return flow volume, before eventually releasing the trigger for ejecting the swelling sealing agent (5) into the assumed arising fractures.

In an embodiment of the invention the drill pipe string (0) is wired, for example with wired signal transmission or otherwise signal transmission. This provides two advantages: firstly, one is always able to communicate with the tool from the surface even when a severe mud loss is occurring; otherwise the mud signal path is discontinued. Secondly, a wired pipe allows a distributed sensor arrangement along the drill pipe string (0) in addition to the sensor arrangement in the tool.

The main body (1) of the mud loss treatment drilling tool does not necessarily have to be the top section of the borehole assembly BHA. The main body (1) may in an embodiment have its upper tooljoint (101U) connected not directly to an above arranged wired or otherwise signalling drill pipe string (0) with a communication line (01) to a topsides monitoring and control system (02), but connected via a drill collar (2) which is also a wired pipe or otherwise signalling system provided with said communication line (01).

The control system (13) algorithm (131) receives the MWD sensor signals during drilling in order to determine an undesired mud loss state. When having determined whether an undesired mud loss state has occurred, the algorithm (131) issues a command signal to said valve actuator (121) to activate the valve system (12) to release the swellable sealant (5) from the tank (10).

In case of the drill bit arriving at a depth of which the borehole comes into contact with a natural fracture, or a fracture is induced from the borehole due to the mud pressure involved in the drilling process, or a combination of the two, an undesired and significant mud loss may suddenly occur. Such a sudden drilling mud loss may be detected as a sudden reduction in the annulus mud pressure (Pa) due to the leakage of drilling mud into the surrounding fractures.

When the valve system (12) opens the outlet (120) of the annular tank (10) the swellable sealant (5) comes in contact with the drilling mud.

In an embodiment of the invention the swellable sealant (5) is arranged for, when ejected from said outlet (120) to said drilling mud, to start reacting with said drilling mud to swell during the time it takes said drilling mud with a portion of said swellable sealant (5) to pass through the drilling bit nozzles, and continue to swell and set while said drilling mud being placed in a fracture extending from a borehole being drilled by said drill bit (3).

In an embodiment the control system may (13) act autonomously, said local downhole control system (13) receiving signals from its local sensors such as the above mentioned sensed by the MWD sensor system (11) with the internal bore sensors (111) and/or annulus sensors (112), such as:

bore mud pressure (111Pb) sensor
bore mud flow velocity (111Vb) sensor (ultrasonic Doppler)
annulus mud pressure (112Pa) sensor, mud pressure bore/annulus differential pressure (Pb-Pa) sensor
annulus mud velocity (112Va) sensor (ultrasonic Doppler)
bore temperature (111Tb) sensor
annulus temperature (112Ta) sensor, temperature bore/annulus differential temperature (Ta-Tb) sensor
bore mud density (111Rho b) sensor
annulus mud density (112Rho a) sensor.

and determines that an undesired mud loss state is occurring. Then the control system (13) may send a triggering command signal (ST) to said valve actuator (121) to activate said valve system (12) for ejecting said swellable sealant (5).

However, such an autonomous control system may be undesirable for several reasons: it may trigger falsely or prematurely based on un-anticipated mud flow states misinterpreted by the local algorithm.

Moreover, a downhole autonomous control system (13) could advantageously have mud flow signals input also as measured at topside, such as Stand pipe pressure, bar
Flow rate in, lpm
Flow rate out, lpm
Traveling block position.

Therefore, in an embodiment of the invention, the control system (13) sends a mud loss state signal (SL) representing said detected undesired mud loss state via a downhole modem (15) (optical, electrical or acoustic) to a surface modem (415) to a surface control system, and awaits receiving a surface triggering confirmation command signal (SC) to said valve actuator (121) to activate said valve system (12) for allowing ejecting said swellable sealant (5).

In case of a loss of mud to the formation or the fractures, there is a risk of losing mud signalling contact with the bottomhole assembly. Therefore, in an embodiment of the invention, when having determined at the surface that a loss of mud situation is occurring, regardless of the downhole control system is able to send the mud loss state signal (SL) representing said detected undesired mud loss state via a downhole modem (15) to a surface modem (415) to a surface control system or not (the mud signal path may have been temporarily lost) one may send signals down to the bottomhole assembly by making a pre-determined series of rotations, selectable among one or more of the following:

halting rotation and reversing it, conducting a series of RH and LH rotations conducting a series of RH rotations interrupted by periods of halt of rotations increasing WOB and decreasing WOB in a predetermined pattern.

running at a predefined rotation speed RPM for a predetermined period of time.

This will enable the driller to command or trigger the bottomhole assembly regardless of the possible absence of other communication channels.

In an embodiment of the invention, after having ejected said swellable sealant (5) and said swellable sealant (5) has halted said undesired mud loss, one may circulate out remaining swellable sealant (5) not having entered into fractures.

The swellable sealant (5) is arranged for swelling and setting within the undesired fractures in the rock formations being drilled through, in order to prevent further outflux of drilling mud from the borehole to the fractures. It may even be designed for hardening after setting in the fractures. However, the resulting shear resistance may develop gradually so as for allowing the swelled agent (5) mixed with drilling mud and rock fluids to set and block the apertures in the fractures, while the shear resistance of the swelling agent (5) mixed with drilling mud around the drill bit, the drill collars and the drilling string will not be high enough to prevent continued rotation and circulation out of such remaining swelling agent. Otherwise the drill string would get stuck.

In an embodiment of the invention one may continue drilling beyond the well depth in which said undesired mud loss state occurred. This is a major advantage of the invention: after having controlled the undesired mud loss, i.e. after and during controlling the undesired mud loss using the present invention, without interrupting the rotation of the drilling string, the drilling may continue essentially uninterrupted by the occurrence of the undesired mud loss.

The invention claimed is:

1. A mud loss treatment drilling tool, comprising:

a main body with a through bore, and an upper tool joint to connect to an above arranged drill pipe string with an associated communication line to and from a topsides monitoring and control system; and a lower tool joint to connect to a below arranged one or more drill collar sections with a lower of said drill collar sections connected to a drill bit with nozzles, wherein said main body is provided with an annular tank with a swellable sealant, wherein said annular tank has an outlet to said through bore, and a valve system having a first valve actuator operable in response to a detection of an undesired mud loss state, and said first valve actuator is operable to allow said annular tank to eject said swellable sealant to said through bore in response to the detection of the undesired mud loss state, and wherein said swellable sealant is arranged, when ejected from said outlet, to contact said drilling mud in said through bore, to start reacting to swell during the time it which said drilling mud with said swellable sealant takes to pass out through the drilling bit nozzles, and continue to swell and set while said drilling mud being placed in a fracture extending from a borehole being drilled by said drill bit.

2. The mud loss treatment tool of claim 1, wherein said valve system comprises a second valve actuator for an inlet valve operable to allow drilling fluid in from the through bore, and wherein said first valve actuator is configured for activating an outlet valve to release said swellable sealant to said main bore.

3. The mud loss treatment drilling tool of claim 2, wherein said annular tank is provided with a piston arranged for driving out said swellable sealant to said valve system.

4. The mud loss treatment drilling tool of claim 2, further comprising at least one sensor selected from the group consisting of:

a bore mud pressure sensor;

a bore mud flow velocity sensor (ultrasound Doppler);

an annulus mud pressure sensor;

a mud pressure bore/annulus differential pressure (Pb-Pa) sensor;

an annulus mud velocity sensor (ultrasound Doppler);

a bore temperature sensor;

an annulus temperature sensor;

a temperature bore/annulus differential temperature (Ta-Tb) sensor;

a bore mud density sensor; and an annulus mud density sensor.

5. The mud loss treatment tool of claim 1, wherein said annular tank has said first valve actuator for a diverter valve arranged near an upper end of said annular tank in said through bore to divert drilling mud to an upper end of said annular tank through an inlet and said outlet is arranged near a lower end of said annular tank back to said through bore, so as for flushing said swellable sealant into said through bore.

6. The mud loss treatment drilling tool of claim 5, further comprising at least one sensor selected from the group consisting of:

a bore mud pressure sensor;

a bore mud flow velocity sensor (ultrasound Doppler);

an annulus mud pressure sensor;

a mud pressure bore/annulus differential pressure (Pb-Pa) sensor;

an annulus mud velocity sensor (ultrasound Doppler);

a bore temperature sensor;

an annulus temperature sensor;

a temperature bore/annulus differential temperature (Ta-Tb) sensor;

a bore mud density sensor; and an annulus mud density sensor.

7. The mud loss treatment drilling tool of claim 1, wherein said annular tank is provided with a piston arranged for driving out said swellable sealant to said valve system.

8. The mud loss treatment drilling tool of claim 7, wherein said annular tank is provided with an inlet valve or pump with a mud balancing pressure inlet from said through bore near an upper end of said annular tank and provided with an inlet valve actuator, said pump or valve contributing to driving said piston.

9. The mud loss treatment drilling tool of claim 7, further comprising at least one sensor selected from the group consisting of:

a bore mud pressure sensor;

a bore mud flow velocity sensor (ultrasound Doppler);

an annulus mud pressure sensor;

a mud pressure bore/annulus differential pressure (Pb-Pa) sensor;

an annulus mud velocity sensor (ultrasound Doppler);

a bore temperature sensor;

an annulus temperature sensor;

a temperature bore/annulus differential temperature (Ta-Tb) sensor;

a bore mud density sensor; and an annulus mud density sensor.

10. The mud loss treatment drilling tool of claim 1, further comprising at least one sensor selected from the group consisting of:

a bore mud pressure sensor;

a bore mud flow velocity sensor (ultrasound Doppler);

an annulus mud pressure sensor;

a mud pressure bore/annulus differential pressure (Pb-Pa) sensor;

an annulus mud velocity sensor (ultrasound Doppler);

a bore temperature sensor;

an annulus temperature sensor;

a temperature bore/annulus differential temperature (Ta-Tb) sensor;

a bore mud density sensor; and an annulus mud density sensor.

11. The mud loss treatment drilling tool of claim 1, wherein said detection of an undesired mud loss state is based on a signal representing said undesired mud loss state communicated via a downhole modem to a surface modem to a topside monitoring and control system, such that a surface triggering command signal is transmitted to said first valve actuator to open said valve system for ejecting said swellable sealant.

12. The mud loss treatment drilling tool of claim 1, wherein said communication line associated with said drilling pipe string is a wired line of said drilling pipe string, said wired line connected between said tool and a topsides monitoring and control system.

13. The mud loss treatment drilling tool of claim 1, wherein said communication line associated with said drilling pipe string is a mud pulse telemetry system in the annulus of said drilling pipe string, said mud pulse telemetry system signalling between said tool and a topsides monitoring and control system.

14. A while drilling mud loss treatment method comprising:

providing a drilling tool main body with a through bore to an above arranged drill pipe string with a communication line to a topsides monitoring and control system, said main body provided with an annular tank, wherein said drilling tool main body is connected to a below arranged one or more drill collar sections with a lower of said drill collar sections connected to a drill bit; and drilling in a well, wherein said annular tank is provided with a swellable sealant, wherein said annular tank has a valve system to an outlet to said through bore, said valve system having a first valve actuator, wherein said first valve actuator is operable to activate said valve system upon detecting an undesired mud loss state, so as for ejecting said swellable sealant to said through bore, and wherein said swellable sealant is arranged for, when ejected from said outlet to said drilling mud, to start reacting with said drilling mud to swell during the time which said drilling mud with a portion of said swellable sealant takes to pass through the drilling bit nozzles, and continue to swell and set while said drilling mud being placed in a fracture extending from a borehole being drilled by said drill bit.

15. The while drilling mud loss treatment method of claim 14, wherein a signal representing said detected undesired mud loss state is transmitted via a downhole modem to a surface modem to said topsides monitoring and control system, and in response, a surface triggering confirmation command signal is transmitted to said first valve actuator to activate said valve system for allowing the tank to eject said swellable sealant.

16. The while drilling mud loss treatment method of claim 14, wherein after having ejected said swellable sealant and said swellable sealant has halted said undesired mud loss, circulating out remaining swellable sealant not having entered into fractures.

17. The while drilling mud loss treatment method of claim 14, further comprising continuing drilling beyond the well depth in which said undesired mud loss state occurred.

18. The while drilling mud loss treatment method according to claim 14, further comprising the steps of:

upon detecting the undesired mud loss status, sending said surface triggering confirmation command signal down to said first valve actuator, making a pre-determined series of drill string rotations, selectable among one or more of from the group consisting of:

halting rotation and reversing it;

conducting a series of RH and LH rotations;

conducting a series of RH rotations interrupted by periods of halt of rotations;

increasing WOB and decreasing WOB in a predetermined pattern; and running at a predefined rotation speed RPM for a predetermined period of time.

19. The while drilling mud loss treatment method according to claim 14, comprising upon detecting the undesired mud loss status, also based on measurements conducted on the surface, sending said surface triggering confirmation command signal down to said first valve actuator.

20. The while drilling mud loss treatment method according to claim 14, comprising sending signals from the tools to the surface, or signals representing surface-based measurements, or said surface triggering confirmation command signal on the pipe string.

* * * * *